US006752080B2

(12) United States Patent
Fukui

(10) Patent No.: US 6,752,080 B2
(45) Date of Patent: Jun. 22, 2004

(54) SHEET MATERIAL HOLDING DEVICE

(75) Inventor: Takashi Fukui, Kanagawa (JP)

(73) Assignee: Fuji Photo Film Co., Ltd., Kanagawa (JP)

( * ) Notice: Subject to any disclaimer, the term of this patent is extended or adjusted under 35 U.S.C. 154(b) by 0 days.

(21) Appl. No.: 10/244,393

(22) Filed: Sep. 17, 2002

(65) Prior Publication Data

US 2003/0051621 A1 Mar. 20, 2003

(30) Foreign Application Priority Data

Sep. 18, 2001 (JP) ..... 2001-283736

(51) Int. Cl.[7] ..... B41F 27/12

(52) U.S. Cl. ..... 101/415.1; 101/409; 101/477; 271/277

(58) Field of Search ..... 101/378, 409, 101/415.1, 477; 271/82, 277; 355/75, 85, 110

(56) References Cited

U.S. PATENT DOCUMENTS 6,003,442 A * 12/1999 Solomon et al. ..... 101/415.1
6,334,392 B1 * 1/2002 Kawada et al. ..... 101/415.1
6,412,413 B1 * 7/2002 Tice et al. ..... 101/409

* cited by examiner

*Primary Examiner*—Leslie J. Evanisko
(74) *Attorney, Agent, or Firm*—Sughrue Mion, PLLC

(57) ABSTRACT

A sheet material holding device applicable to an automatic printing plate exposure apparatus is disclosed. A notched groove is disposed in an upper surface of a clamp body corresponding to the pressing direction of a press shaft of the sheet material holding device, and a point of contact between the press shaft and the groove is adjusted. A straight line connecting the contact point with an axial center of a rotating shaft intersects a circular trajectory of the contact point at a substantially right angle. Substantially all of the pressing force of the press shaft acts to pivot the clamp body, whereby a rotary drum is prevented from being rotated at the time of pressing.

20 Claims, 6 Drawing Sheets

SHEET MATERIAL HOLDING DEVICE

BACKGROUND OF THE INVENTION

1. Field of the Invention

The present invention relates to a sheet material holding device for holding sheet material in a wound state on a drum by clamping a winding-direction end of the sheet material wound around a peripheral surface of the drum to the peripheral surface of the drum.

2. Description of the Related Art

As apparatus for exposing printing plates, technology has been developed in which, using sheet-like recording materials, and particularly a printing plate comprising a support having disposed thereon a photosensitive layer, an image is recorded with a laser beam or the like directly on an emulsion surface that is a recording layer of the printing plate. With such technology, it has become possible to quickly record an image on a printing plate.

In automatic printing plate exposure apparatus employing technology for recording an image on a printing plate, the printing plate is sent to an exposure section with a flat plate being used as a support surface. The printing plate is received in the exposure section, positioned into a predetermined position, and exposed.

In the exposure section, a rotary drum is used to support the printing plate. The sent printing plate is wound around a peripheral surface of the rotary drum and held thereat. The rotary drum rotates in the main scanning direction. An image is exposed on the printing plate by moving a recording head along the axis of the rotary drum (i.e., sub-scanning).

A clamp is generally used to hold the leading and trailing ends of the printing plate to the rotary drum.

The clamp includes a clamp body that pivots in the peripheral direction of the rotary drum, with a column attached to the rotary drum serving as a fulcrum. The clamp body is urged by an urging device such as a spring to a clamping position at which a clamping portion disposed at one end of the clamp body is brought into contact with the peripheral surface of the rotary drum.

When the printing plate is sent to the rotary drum, an upper surface of the other end of the clamp body is pressed by extending a telescopic rod, whereby the clamping portion is separated, counter to the urging force of the urging device, from the peripheral surface of the rotary drum to a released position. In this state, the printing plate can be inserted between the clamping portion and the peripheral surface of the rotary drum. The telescopic rod is thereafter retracted, whereby the clamping portion is returned to the clamping position by the urging force of the urging device and holds the printing plate.

However, when the clamp body rotates with the column as a fulcrum, the vector of the force of extension/contraction, and mainly the force of extension, of the rod includes a directional force that causes the rotary drum to rotate. Due to this rotational force, the rotary drum is not fixed in a predetermined position and occasionally oscillates. Because the rotary drum must therefore be fixed by an additional mechanism, the structure of the apparatus becomes complicated, which results in stretching out working time until the printing plate is held.

SUMMARY OF THE INVENTION

In view of the aforementioned circumstances, it is an object of the present invention to provide a sheet material holding device capable of securely holding a sheet material, without fixing a rotary drum, and shortening holding operation time.

A first aspect of the invention is a device for holding sheet material in a wound state around a peripheral surface of a rotary drum, the device comprising: a column disposable at a predetermined position on the peripheral surface of the rotary drum; a clamp body pivotable about the column, the clamp body including one end comprising a clamping portion for clamping the sheet material to the peripheral surface of the rotary drum, the clamping portion being movable into at least clamping and released positions; an urging device for urging the clamping portion of the clamp body into the clamping position; and a clamping unit disposable spaced away from the rotary drum and including a linearly movable rod, which the clamping unit moves to contact an end of the rod with the clamp body and counters urging force of the urging device to thereby pivot the clamp body into the released position, wherein a locus of the linear movement of the rod and a position of contact between the clamp body and the rod are such that a straight line C and an axial line D of the rod intersect at a substantially right angle, the intersection being between a straight line A and a straight line B, the straight line A connecting a clamp body pivot point Y in the column and a contact point X between the end of the rod and the clamp body when the clamping portion is in the clamping position, the straight line B connecting the pivot point Y and a contact point Z between the end of the rod and the clamp body when the clamping portion is in the released position, the straight line C passing through the pivot point Y and being parallel to a line tangential to the peripheral surface of the rotary drum at a point where a line of shortest distance between the pivot point Y and the peripheral surface of the rotary drum intersects with the peripheral surface of the rotary drum.

According to the first aspect of the invention, the rod of the clamping unit is extendable so as to abut and press against the clamp body. Due to this arrangement, when the clamp body is pivoted about the column, the extending direction of the rod normally faces towards an axial center of the drum.

While the rod forward end is in contact with the clamp body, if the movement direction of the rod did not meet the axial center of the drum, a force for rotating the drum would be generated.

Therefore, according to the first aspect of the invention, a straight line C and an axial movement line of the rod intersects substantially at right angles with each other between a straight line A and a straight line B. Here, the straight line A connects a contact point between the rod forward end and the clamp body in a state that the clamping portion is in the clamping position with a rotational center of the column in the clamp body. The straight line B connects a contact point between the rod forward end and the clamp body in the state that the clamping portion is in the releasing position respectively with the rotational center of the column in the clamp body. The straight line C passes through the rotational center of the column of the clamp body and is parallel with drum tangent line at an intersection between a radius of the rotational center and the drum peripheral surface. As a result, a scope (widening angle) of directions of unnecessary force can be leveled and minimized with respect to entire range of pivot of the clamp body. Thus, defects due to rotating the drum by the press force of the rod can be eliminated.

Such arrangement can be carried out by adjusting a linear moving locus of the rod of the clamping unit and the contact position between the clamp body and the rod.

A second aspect of the invention is a device for holding sheet material in a wound state around a peripheral surface of a rotary drum, the device comprising: a column disposable at a predetermined position on the peripheral surface of the rotary drum; a clamp body pivotable about the column, the clamp body including one end comprising a clamping portion for clamping the sheet material to the peripheral surface of the rotary drum, the clamping portion being movable into at least clamping and released positions; an urging device for urging the clamping portion of the clamp body into the clamping position; and a clamping unit disposable spaced away from the rotary drum and including a linearly movable rod, which the clamping unit moves to contact an end of the rod with the clamp body and counters urging force of the urging device to thereby pivot the clamp body into the released position, wherein a locus of the linear movement of the rod and a position of contact between the clamp body and the rod are such that a straight line A intersects at a substantially right angle a locus E of movement of a contact point X at the time of movement of the clamping portion between the clamping and the releasing positions, the straight line A connecting a clamp body pivot point Y in the column and the contact point X between the end of the rod and the clamp body when the clamping portion is in the clamping position.

According to the second aspect of the invention, similarly to the first aspect, the rod of the clamping unit is extendable so as to abut and press against the clamp body. Due to this arrangement, when the clamp body is pivoted about the column, the extending direction of the rod normally faces towards an axial center of the drum.

The rod forward end abuts against the clamp body when the clamping portion is in the clamping position. From this state, the clamp body starts pivoting. When the stopping clamp body due to the inertial law is to be moved, the magnitude of force reaches its peak. Once the clamp body starts pivoting, this peak magnitude of force is excessive for the clamp body.

Therefore, according to the second aspect, a straight line intersects substantially at right angles with a movement locus of a contact point. The straight line connects the contact point touching the rod in the clamping position of the clamp body. As a result, the unnecessary force can be directed to the axial center of the drum, and thus defects due to rotating the drum by the press force of the rod can be eliminated.

Such arrangement can be carried out by adjusting the linear moving locus of the rod of the clamping unit and the contact position between the clamp body and the rod.

DESCRIPTION OF THE PREFERRED EMBODIMENTS

Figure 1:
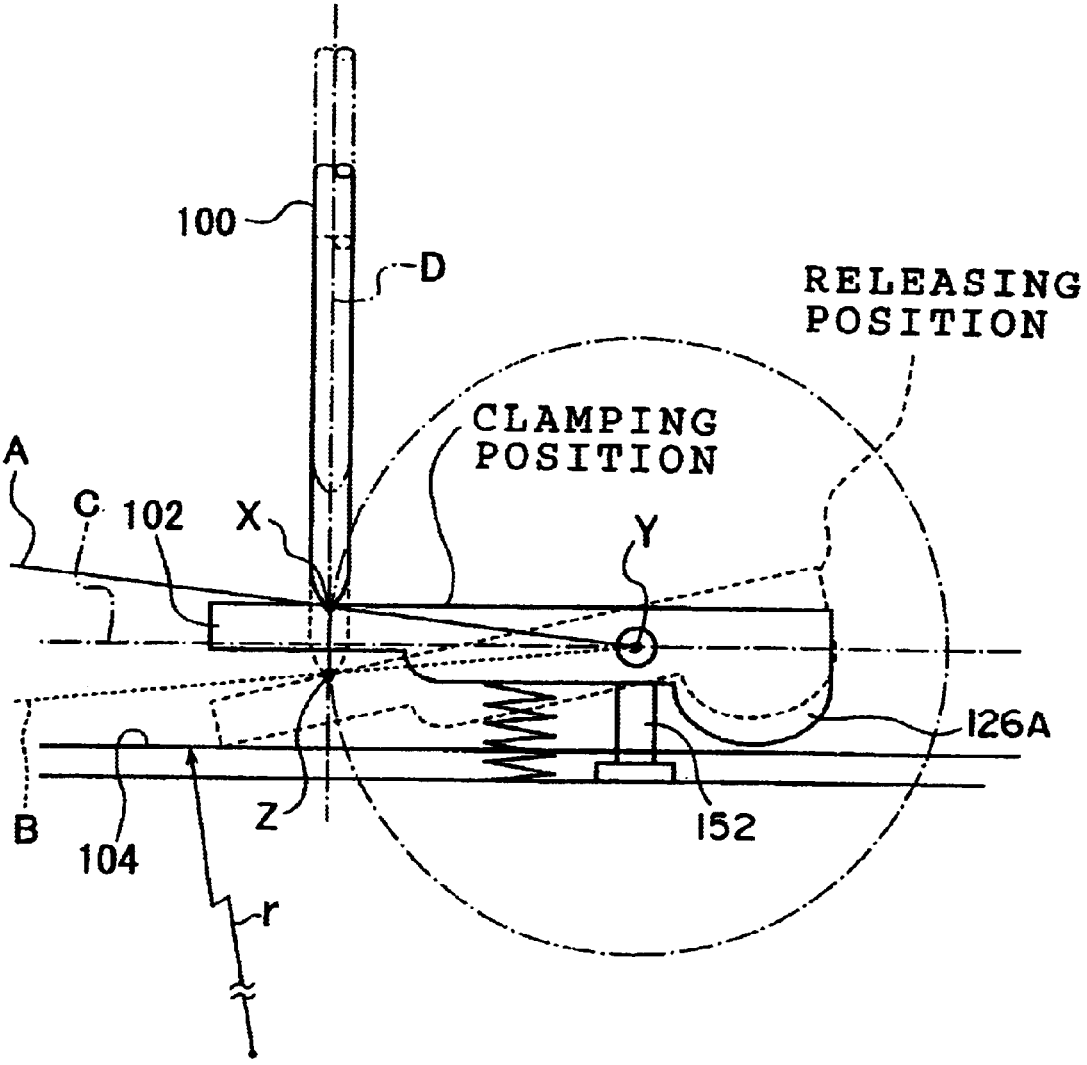
FIG. 1 is a schematic diagram of a sheet holding device of the present invention.

According to an embodiment of the invention, a rod 100 of a clamping unit is extended to abut against a clamp body 102, as shown in FIG. 1. When the rod 100 is further extended so that the clamp body 102 is made to pivot about a pivot point Y in a column 152, the direction in which the rod 100 extends is ordinarily oriented towards an axial center of a drum 104. Because a radius r of the drum 104 is large, the peripheral surface of the drum 104 is represented by a substantially straight line in FIG. 1.

When the direction in which the rod 100 moves is not oriented towards the axial center of the drum 104 while an end of the rod 100 is in contact with the clamp body 102, a force that causes the drum 104 to rotate is generated.

In the present embodiment, it is possible to eliminate the drawback of the drum 104 being rotated by the pressing force of the rod 100, and to minimize the range (spreading angle) of orientation of an unnecessary force on average across the overall rotational movement of the rod 100, by structuring the clamping unit in the following manner. As shown in FIG. 1, the pivot point Y forms the center of an imaginary circle (indicated by a chain line), with the radius of the circle being equivalent to the distance from the pivot point Y to a point X of contact between the end of the rod 100 and the clamp body 102 when a clamping portion 126A of the clamp body 102 is disposed in a clamping position (indicated in FIG. 1 by a solid line). Contact point Z represents a point of contact between the end of the rod 100 and the clamp body 102 when the clamping portion is disposed in a released position (indicated in FIG. 1 by a dotted line). A straight line A connects the pivot point Y and the contact point X, and a straight line B connects the pivot point Y and the contact point Z. A straight line C, which passes through the pivot point Y and is parallel to a line that is tangential to the peripheral surface of the drum 104 at a point where a line of the shortest distance between the pivot point Y and the peripheral surface of the drum 104 intersects with the peripheral surface of the drum 104, is disposed between the straight lines A and B. The straight line C intersects, at a substantially right angle, a line D coinciding with the axis of movement of the rod 100.

Figure 2:
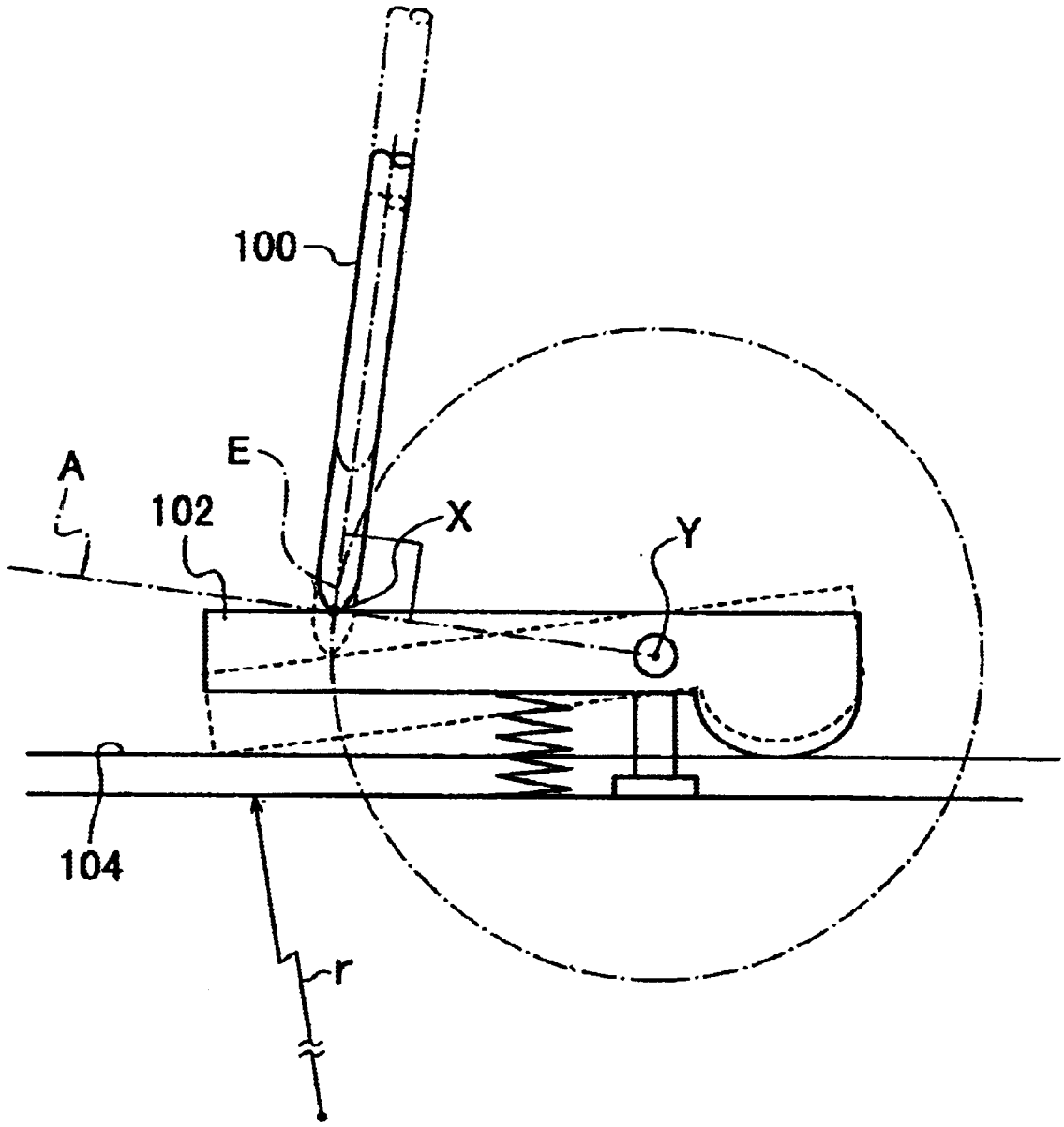
FIG. 2 is a schematic diagram of another sheet holding device of the invention.

According to another embodiment of the invention, the rod 100 of the clamping unit is extended to abut against the clamp body 102, as shown in FIG. 2. When the rod 100 is further extended so that the clamp body 102 is made to pivot about the pivot point Y in the column, the direction in which the rod 100 extends is ordinarily oriented towards an axial center of the drum 104. Because a radius r of the drum is large, the peripheral surface of the drum 104 is represented by a substantially straight line in FIG. 2.

The moment that the end of the rod abuts against the clamp body 102 is when the clamping portion is in the clamping position. This is the moment that the clamp body 102 starts to pivot. The force necessary to begin moving the clamp body 102 is greatest at this time because the clamp body is stationary due to the law of inertia. However, this peak force becomes more than necessary once the clamp body 102 has started pivoting.

In the other embodiment of the invention, it is possible to eliminate the drawback of the drum 104 being rotated by the pressing force of the rod 100, and to direct the unnecessary force in the axial direction of the drum 104, by structuring the clamping unit such that the straight line A, which connects the pivot point Y and the contact point X representing contact between the end of the rod 100 and the clamp body 102 when the clamping portion is disposed in the clamping position, intersects, at a substantially right angle, a locus E of movement of the contact point X.

Figure 3:
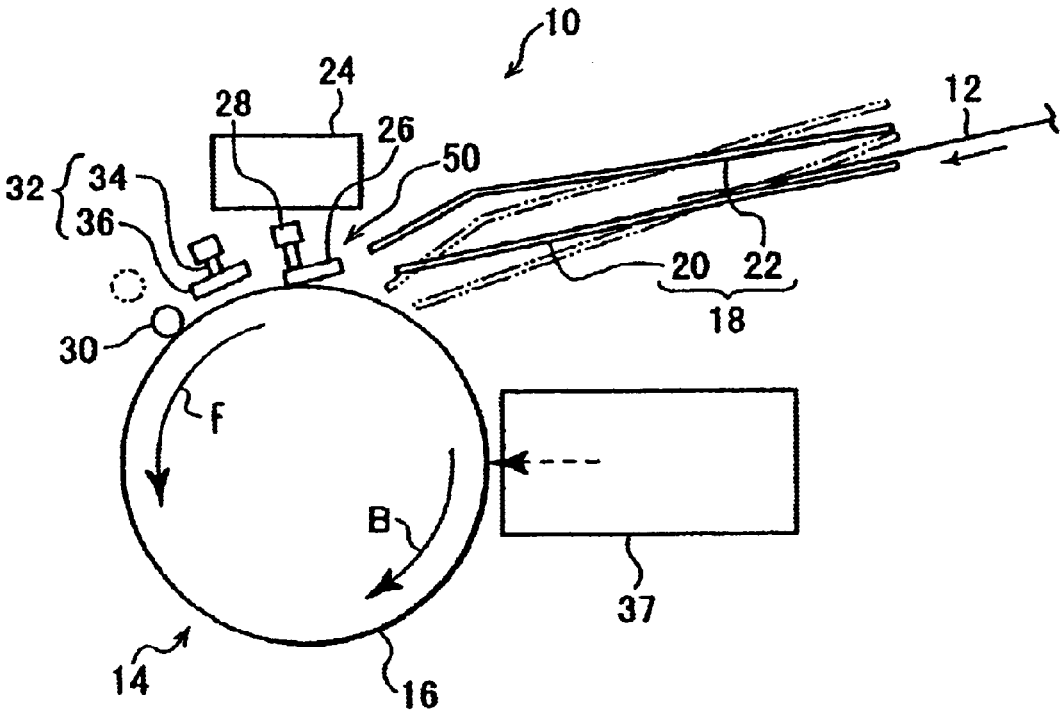
FIG. 3 is a schematic diagram of an automatic printing plate exposure apparatus according to an embodiment.

FIG. 3 shows an automatic printing plate exposure apparatus 10 relating to an embodiment of the invention.

The automatic printing plate exposure apparatus 10 is divided into two blocks: an exposure section 14 that irradiates an image forming layer of a printing plate 12 with a light beam to thereby expose an image; and a conveyance guide unit 18 that conveys the printing plate 12 to the exposure section 14. Once the printing plate 12 has been exposed by the automatic printing plate exposure apparatus 10, the printing plate 12 is fed to an unillustrated developing apparatus disposed adjacent to the automatic printing plate exposure apparatus 10.

The exposure section 14 includes, as a main component, a rotary drum 16 that has a peripheral surface around which the printing plate 12 is wound and held. The printing plate 12 is guided by the conveyance guide unit 18 and fed to the rotary drum 16 from a direction tangential to the rotary drum 16. The conveyance guide unit 18 includes a plate-feeding guide 20 and a plate discharge guide 22.

The plate-feeding guide 20 and the plate discharge guide 22 are positioned relative to each other such that they form a lateral V-like shape, and pivot at a predetermined angle about a vicinity of the center of FIG. 3. The plate-feeding guide 20 and the plate discharge guide 22 can be selectively pivoted to correspond to the rotary drum 16. In other words, the plate-feeding guide 20 and the plate discharge guide 22 can be selectively positioned in a direction tangential to the rotary drum 16.

A puncher 24 is disposed in the vicinity of the conveyance guide unit 18. By facing the plate-feeding guide 20 towards the puncher 24, the leading end of the printing plate 12 can be fed to the puncher 24. Namely, the printing plate 12 is first guided by the plate-feeding guide 20 and fed to the puncher 24. After a positioning notch is punched in the leading end of the printing plate 12, the printing plate 12 is temporarily returned to the plate-feeding guide 20. Thereafter, the conveyance guide unit 18 is rotated, and the printing plate 12 is moved to a position corresponding to the rotary drum 16.

The rotary drum 16 is rotated, by an unillustrated drive, in a direction in which the printing plate 12 is attached to the rotary drum 1 and exposed (i.e., the direction of arrow F in FIG. 3), and in a direction in which the printing plate 12 is detached from the rotary drum (i.e., the direction of arrow B in FIG. 3). The direction in which the printing plate 12 is detached from the rotary drum 16 is opposite to the direction in which the printing plate 12 is attached to the rotary drum 16 and exposed.

As shown in FIG. 3, a leading end clamp 50 is attached to a predetermined position on the outer peripheral surface of the rotary drum 16. When the printing plate 12 is attached to the rotary drum 16, the leading end clamp 50 stops the rotary drum 16 at a position facing the leading end of the printing plate 12 fed by the plate-feeding guide 20. This position is a printing plate attachment position.

Figure 4:
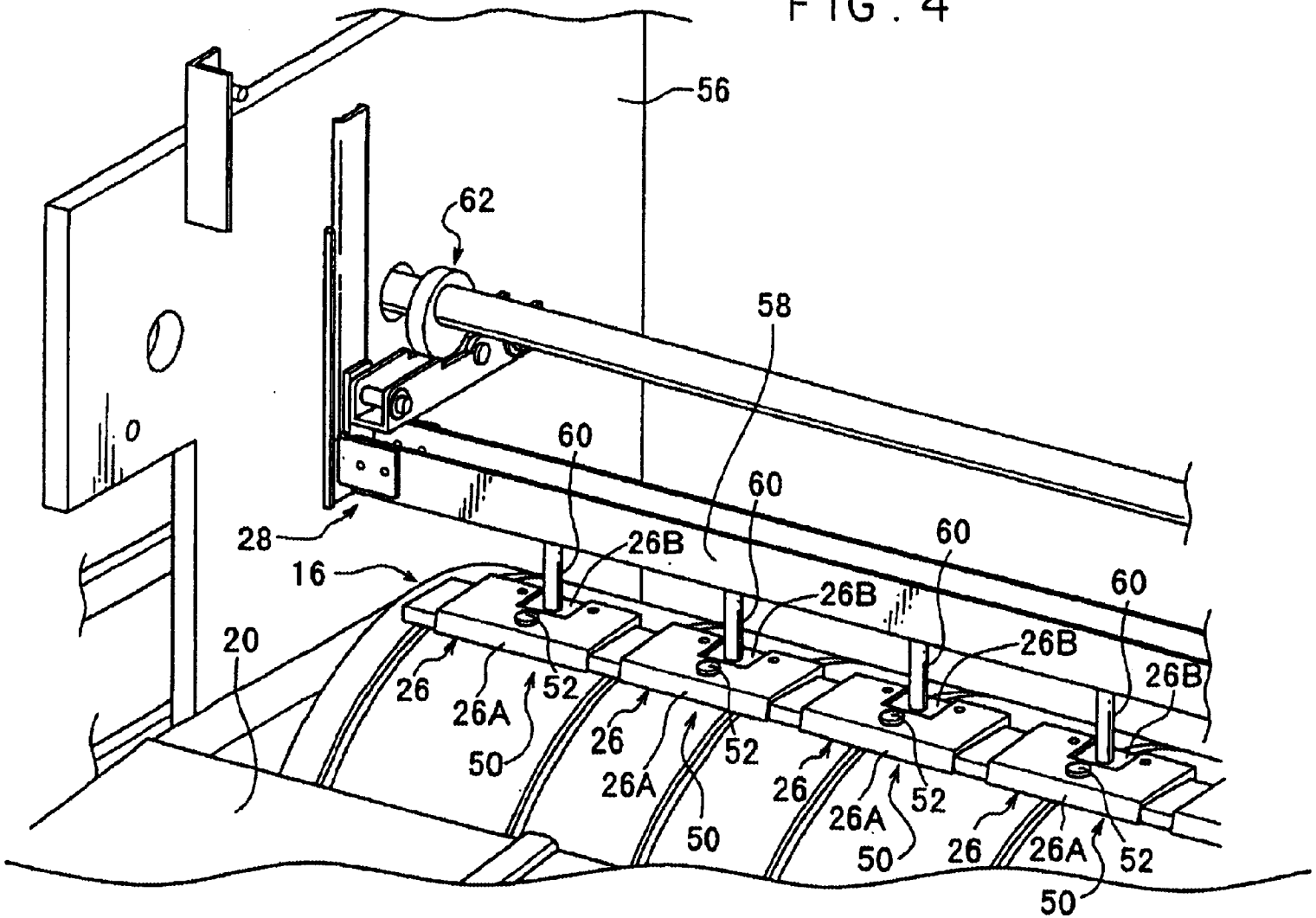
FIG. 4 is an enlarged perspective view showing leading end clamps and their vicinity.

As shown in FIG. 4, a plurality of the leading end clamps 50 is disposed along the axial direction of the rotary drum 16, and the leading end clamps 50 are arranged in one row. Each leading end clamp 50 can be operated independently, and includes a clamp body 26 for clamping the printing plate 12 onto the peripheral surface of the rotary drum 16.

Figure 5:
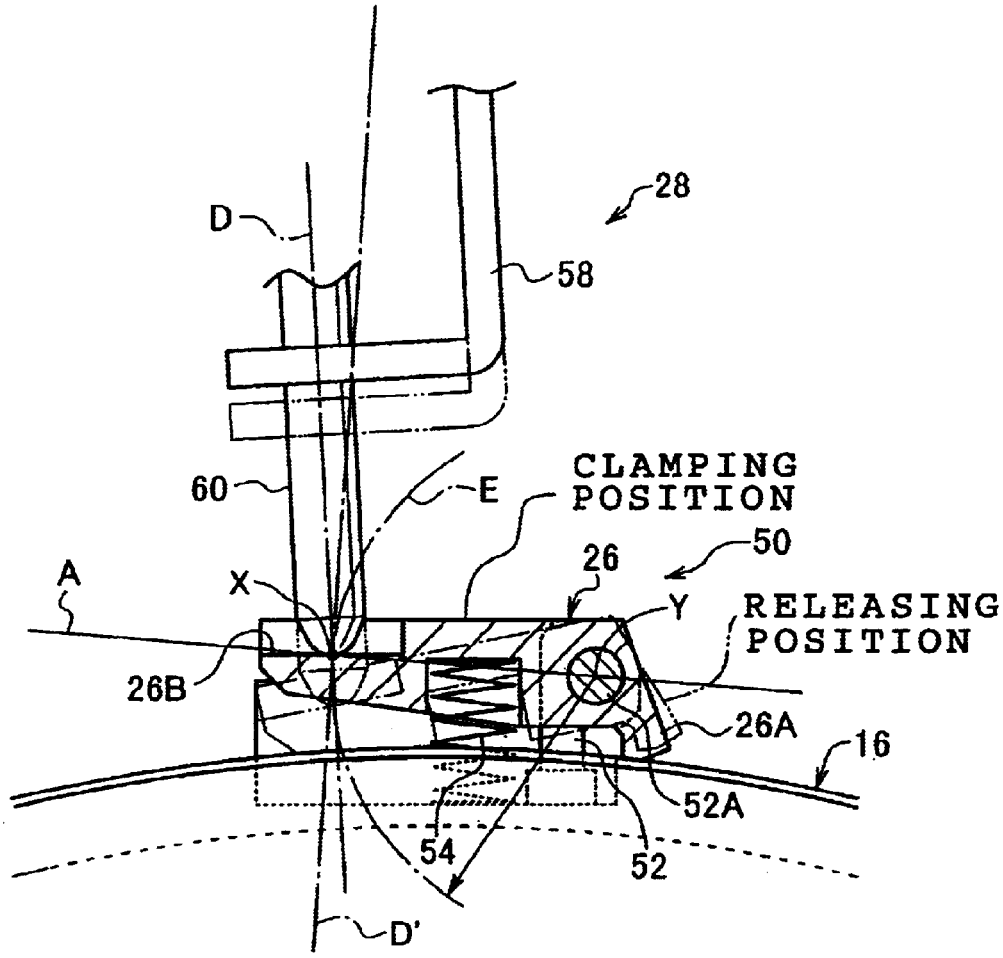
FIG. 5 is a side view of the leading end clamps.

As shown in FIG. 5, a clamping portion 26A that actually presses the printing plate 12 towards the rotary drum 16 and clamps the printing plate 12 thereto is disposed at a long side of the clamp body 26.

Moreover, the clamp body 26 is rotatably supported by rotary shaft 52A attached to a column 52 that is attached to the rotary drum 16.

The column 52 is positioned, with respect to the peripheral direction of the rotary drum 16, nearer to the long side of the leading end clamp 50 disposed with the clamping portion 26A than to the other long side of the leading end clamp 50. Using the rotary shaft 52A of the column 52 as a fulcrum, the clamp body 26 can pivot like a seesaw.

A compression coil spring 54, which serves as an urging device, is disposed between the peripheral surface of the rotary drum 16 and the clamp body 26. The compression coil spring 54 is disposed, with respect to the column 52, opposite to the side at which the clamping portion 26A is disposed, and urges the clamping portion 26A of the clamp body 26 in a direction approaching the peripheral surface of the rotary drum 16, as shown in FIG. 5.

The clamp 26 can thus clamp the leading end of the printing plate 12, which is fed from a directional tangential to the rotary drum 16 and positioned between the clamping portion 26A and the peripheral surface of the rotary drum 16. This is a clamping position of the clamp body 26.

A clamp switching unit 28, which serves as a moving device corresponding to the leading end clamp 50, is disposed above the rotational drum 16 in FIG. 4.

The clamp switching unit 28 spans the distance between a pair of side plates 56 that axially support both ends of the rotating shaft of the rotary drum 16.

The clamp switching unit 28 comprises a reciprocating block 58, which is attached to the side plates 56 so as to be capable of moving towards and away from the rotary drum 16, and press shafts 60, which are attached to the reciprocating block 58 and arranged to correspond to the leading end clamps 50.

Longitudinal-direction ends (i.e., ends in the axial direction of the rotary drum 16) of the reciprocating block 58 are connected to drive mechanisms 62. Driving force of the drive mechanism 62 raises and lowers the reciprocating block 58, while a uniform interval in the longitudinal direction is maintained between the reciprocating block 58 and the rotary drum 16.

When the reciprocating block 58 is lowered, the press shaft 60 abuts against a bottom surface of a notched groove 26B in the clamp body 26, whereby the clamp body 26 is pressed down. This pressing force counters the urging force of the compression coil spring 54 and causes the clamping portion 26A to separate from the rotary drum 16. Thus, the printing plate 12 can be inserted between the clamping portions 26A and the peripheral surface of the rotary drum 16. This is a releasing position of the clamp 26.

At this time, the printing plate 12 abuts against an unillustrated positioning pin that protrudes from a predetermined position on the peripheral surface of the rotary drum 16, whereby the printing plate 12 is positioned on the rotary drum 16.

When the printing plate 12 is positioned, the drive mechanisms 62 drivingly raise the reciprocating block 58. Thus, the leading end of the printing plate 12 is clamped and held between the clamping portions 26A of the clamp bodies 26 and the peripheral surface of the rotary drum 16.

In the present embodiment, the depth of the notched groove 26B is set in accordance with the following condition.

Namely, as shown in FIG. 5, the depth of the notched groove 26B is set such that a straight line A, which connects a contact point X and a pivot point Y (i.e., a rotational center of the rotary shaft 52A) in the column 52 of the leading end clamp 50, intersects a locus E at a substantially right angle. The contact point X represents the point of contact between the press shaft 60 and the bottom surface of the notched groove 26B when the clamp body 26 is in the clamping position. The locus E represents the movement of the contact point X, and is a substantially circular trajectory.

When the depth of the groove 26B cannot be set in accordance with the above condition (e.g., when the angle of intersection is not a substantially right angle), the press shaft 60 can be tilted so that a line coinciding with the axis of movement of the press shaft 60 is shifted from line D to line D', as shown in FIG. 5.

By effecting the above setting and assembling the respective sections, it becomes possible to create a state in which a force causing the rotary drum 16 to rotate is not added when the pressing force exerted by the press shaft 60 acts in the direction in which the clamp body 26 is caused to pivot about the rotating shaft 52A. As a result, it is not necessary to dispose a braking mechanism or the like on the rotary drum 16 itself.

As shown in FIG. 3, when the leading end of the printing plate 12 is fixed to the rotary drum 16, the rotary drum 16 is rotated in the direction of arrow A. As a result, the printing plate 12 fed from the plate-feeding guide 20 of the conveyance guide unit 18 is wound around the peripheral surface of the rotary drum 16.

A squeeze roller 30 is disposed downstream in the direction of arrow A from the printing plate attachment position, in the vicinity of the peripheral surface of the rotary drum 16. The squeeze roller 30 moves towards the rotary drum 16 and presses the printing plate 12 wound around the rotary drum 16 towards the rotary drum 16, to thereby bring the printing plate 12 into close contact with the peripheral surface of the rotary drum 16.

A detachable trailing end clamp unit 32 is disposed upstream in the direction of arrow A from the squeeze roller 30, in a vicinity of the rotary drum 16. The detachable trailing end clamp unit 32 includes a shaft 34, which projects towards the rotary drum 16, and a trailing end clamp 36, which is attached to an end of the shaft 34.

When the trailing end of the printing plate 12 wound around the rotary drum 16 faces the detachable trailing end clamp unit 32, the shaft 34 is extended to attach the trailing end clamp 36 at a predetermined position on the rotary drum 16. As a result, the trailing end clamp 36 clamps and holds the trailing end of the printing plate 12 to the rotary drum 16.

The trailing end clamp 36 has the same structure as that of the leading end clamp 50, except that the trailing end clamp 36 is detachable from the rotary drum 16.

Once the leading and the trailing ends of the printing plate 12 are held on the rotary drum 16, the squeeze roller 30 is moved away from the rotary drum 16. Thereafter, while the rotary drum 16 is rotated at a predetermined high rotational speed, a light beam that has been modulated on the basis on image data is irradiated from a recording head 37 in synchronization with the rotary drum 16. As a result, the printing plate 12 is scan-exposed on the basis of the image data.

When the printing plate 12 has been scan-exposed, the trailing end clamp 36 holding the trailing end of the printing plate 12 temporarily stops the rotary drum 16 at a position facing the detachable trailing end clamp unit 32, and the trailing end clamp 36 is moved away from the rotary drum 16. As a result, the trailing end of the printing plate 12 is released.

Thereafter, the rotary drum 16 is rotated in the direction in which the printing plate 12 is removed, whereby the printing plate 12 is discharged trailing end first to the plate discharge guide 22 of the conveyance guide unit 18 along a direction tangential to the rotary drum 16. The printing plate 12 is then conveyed to the developing apparatus.

Description will now be given of the operation of the present embodiment.

The printing plate 12 is fed to the plate-feeding guide 20 of the carrying guide unit 18. If it is necessary to punch the printing plate 12, the conveyance guide unit 18 is switched towards the puncher 24 and the plate-feeding guide 20 is corresponded to the puncher 24.

The leading end of the printing plate 12 is punched by the puncher 24, and then the printing plate 12 is returned to the plate-feeding guide 20 and temporarily positioned.

When the printing plate 12 is to be exposed, the conveyance guide unit 18 is switched towards the rotary drum 16 and the plate-feeding guide 20 is corresponded to the rotary drum 16. As a result, the printing plate 12 can be fed from the tangent direction of the rotary drum 16 to the rotary drum 16.

The fed printing plate 12 is wound closely around and attached to the peripheral surface of the rotary drum 16 by the leading end clamps 50 and the trailing end clamps 36. Thus, the positioning of the printing plate 12 is completed for exposure.

Description will now be given of the process by which the leading end of the printing plate 12 is clamped by the leading end clamps 50.

The clamp switching unit 38 faces the reciprocating block 58 while the rotary drum 16 stands by at a predetermined position at which the printing plate 12 is received.

At this time, the reciprocating block 58 is disposed in the lowest position by the driving force of the drive mechanisms 62. As a result, the press shaft 60 presses the clamp body 26, and the clamp body 26 pivots about the rotating shaft 52A of the column 52 counter to the urging force of the compression coil spring 54. The clamping portion 26A is thus separated from the peripheral surface of the rotary drum 16 and a gap is generated, whereby the printing plate 12 can be received (released position).

When the printing plate 12 enters the gap and is positioned in a predetermined position, the reciprocating block 58 is raised by the driving force of the drive mechanism 62. Namely, the reciprocating block 58 starts moving away from the rotary drum 16. As a result, the clamp body 26 moves from the released position to the clamping position, and the printing plate 12 is clamped between the clamping portion 26A and the rotary drum 16.

Here, the contact point X is on the bottom surface of the notched groove 26B, where the press shaft 60 is lowered and brought into contact with the clamp body 26. The depth of the notched groove 26B is set such that the straight line A connecting the contact point X with the pivot point Y intersects at a substantially right angle with the locus E of movement of the contact point X.

As a result, the pressing force of the press shaft 60 is directed in a direction tangential to the circular trajectory of the locus E, whereby it becomes possible for substantially all of the pressing force to act for pivoting the clamp body 26 and not for rotating the rotary drum 16. The structure of the apparatus can therefore be simplified because it is not necessary to inhibit the rotation of the rotary drum 16 with a separate braking mechanism or the like when the printing plate 12 is clamped by the leading end clamps 50.

When the printing plate 12 is wound around and held to the rotary drum 16, the image data is read and exposure to the light beam from the recording head 37 is initiated. Exposure is conducted by scan-exposing the printing plate 12, wherein the recording head 37 is moved in the axial direction of the rotary drum 16 while the rotary drum 16 rotates at a high speed.

When the printing plate 12 has been scan-exposed, the conveyance guide unit 18 is switched so that the plate discharge guide 22 faces the rotary drum 16. Next, the printing plate 12 wound around the rotary drum 16 is discharged in a direction tangential to the rotary drum 16, and the printing plate 12 is fed to the plate discharge guide 22.

When the printing plate 12 is fed to the plate discharge guide 22, the conveyance guide unit 18 is switched so that the plate discharge guide 22 faces a port through which the printing plate 12 is discharged to a developing apparatus, where the discharged printing plate 12 is developed.

According to the present embodiment, the notched groove 26B is disposed in the upper surface of the clamp body 26 corresponding to the pressing direction of the press shaft 60. The point X of contact between the press shaft 60 and the groove 26B is set so that the straight line A connecting the contact point X with the pivot point Y intersects at a substantially right angle with the locus E of the contact point X. Consequently, substantially all of the pressing force of the press shaft 60 acts to pivot the clamp body 26. Thus, the rotation of the rotary drum 16 can be prevented at the time of the pressing.

Figure 6:
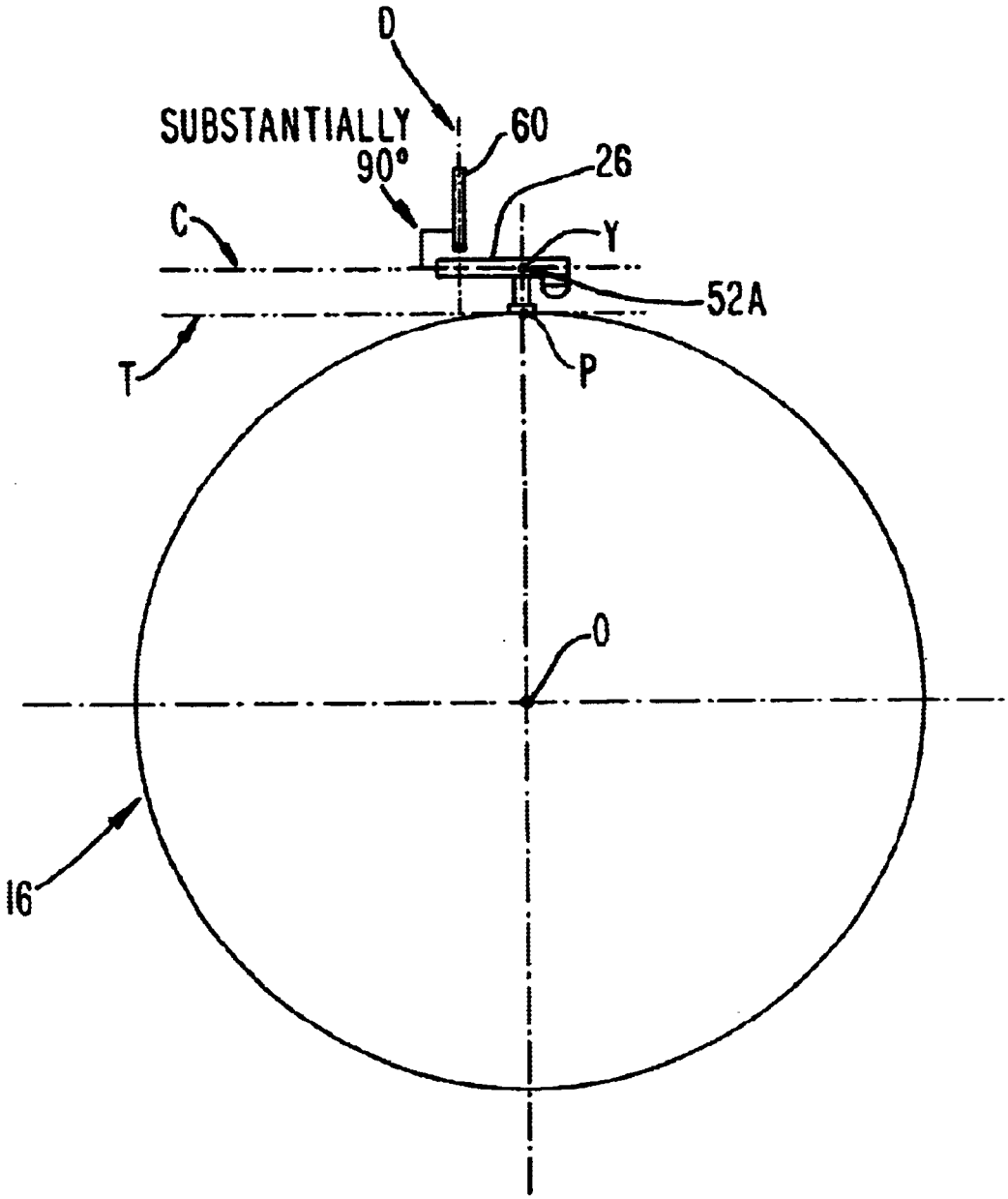
FIG. 6 is an enlarged side view of the leading end clamps.

With additional reference to FIG. 6, description has been given in the present embodiment of an example in which the pressing force of the press shaft 60 is directed in the most suitable direction. However, the invention can be configured such that there is a period in which the straight line C, which passes through the rotational center Y of the rotating shaft 52A and is parallel to a line T that is tangential to the peripheral surface of the rotary drum 16 at a point P where a line of the shortest distance between the rotational center Y and the peripheral surface of the rotary drum 16 intersects with the peripheral surface of the rotary drum 16, intersects at a substantially right angle, the line D coinciding with the axial movement of the press shaft 60 while the clamp body 26 moves between the released position and the clamping position. Reference character O represents a center of the drum 16. As a result, in comparison with the case where no consideration is given to determining the pressing direction of the press shaft 60, the pressing direction can be controlled to an extent that it is not necessary to use a braking mechanism for the rotary drum 16.

As described above, the invention can securely hold a sheet material without fixing a rotary drum. There is thus the excellent effect that holding operation time can be shortened.

What is claimed is:

1. A device for holding sheet material in a wound state around a peripheral surface of a rotary drum, the device comprising:

a column disposable at a predetermined position on the peripheral surface of the rotary drum;

a clamp body pivotable about the column, the clamp body including one end comprising a clamping portion for clamping the sheet material to the peripheral surface of the rotary drum, the clamping portion being movable into at least clamping and released positions;

an urging device for urging the clamping portion of the clamp body into the clamping position; and a clamping unit disposably spaced away from the rotary drum and including a linearly movable rod, which the clamping unit moves to contact an end of the rod with the clamp body and counters urging force of the urging device to thereby pivot the clamp body into the released position, wherein a locus of the linear movement of the rod and a position of contact between the clamp body and the rod are such that a straight line (C) and an axial line (D) of the rod intersect at a substantially right angle, the intersection being between a straight line (A) and a straight line (B), the straight line (A) connecting a clamp body pivot point (Y) in the column and a contact point (X) between the end of the rod and the clamp body when the clamping portion is in the clamping position, the straight line (B) connecting the pivot point (Y) and a contact point (Z) between the end of the rod and the clamp body when the clamping portion is in the released position, the straight line (C) passing through the pivot point (Y) and being parallel to a line tangential to the peripheral surface of the rotary drum at a point where a line of shortest distance between the pivot point (Y) and the peripheral surface of the rotary drum intersects with the peripheral surface of the rotary drum.

2. The device of claim 1, further comprising a rotatable shaft attached to the column, with the rotatable shaft rotatably supporting the clamp body.

3. The device of claim 1, wherein the urging device includes a coil spring disposed between the peripheral surface of the rotary drum and the clamp body and urges the clamping portion towards the peripheral surface of the rotary drum.

4. The device of claim 1, wherein a pair of side plates axially supports the rotary drum, and the clamping unit is disposable spanning the distance between the side plates, the clamping unit including a reciprocating block attachable to the side plates so as to be movable towards and away from the drum, and the rod is connected to the reciprocating block to correspond to the clamp body.

5. The device of claim 1, wherein the clamp body includes a notched groove disposed to correspond to the end of the rod, and the contact point (X) is on a bottom surface of the notched groove.

6. The device of claim 1, further comprising a trailing end clamp unit removably attachable downstream from the clamping unit with respect to a rotating direction of the rotary drum, with the trailing end clamp unit having substantially the same structure as the clamping unit and being detachable from the rotary drum.

7. A device for holding sheet material in a wound state around a peripheral surface of a rotary drum, the device comprising:

a column disposable at a predetermined position on the peripheral surface of the rotary drum;

a clamp body pivotable about the column, the clamp body including one end comprising a clamping portion for clamping the sheet material to the peripheral surface of the rotary drum, the clamping portion being movable into at least clamping and released positions;

an urging device for urging the clamping portion of the clamp body into the clamping position; and a clamping unit disposably spaced away from the rotary drum and including a linearly movable rod, which the clamping unit moves to contact an end of the rod with the clamp body and counters urging force of the urging device to thereby pivot the clamp body into the released position, wherein a locus of the linear movement of the rod and a position of contact between the clamp body and the rod are such that a straight line (A) intersects at a substantially right angle a locus (E) of movement of a contact point (X) at the time of movement of the clamping portion between the clamping and the releasing positions, the straight line (A) connecting a clamp body pivot point (Y) in the column and the contact point (X) between the end of the rod and the clamp body when the clamping portion is in the clamping position.

8. The device of claim 7, further comprising a rotatable shaft attached to the column, with the rotatable shaft rotatably supporting the clamp body.

9. The device of claim 7, wherein the urging device includes a coil spring disposed between the peripheral surface of the rotary drum and the clamp body and urges the clamping portion towards the peripheral surface of the rotary drum.

10. The device of claim 7, wherein a pair of side plates axially supports the rotary drum, and the clamping unit is disposable spanning the distance between the side plates, the clamping unit including a reciprocating block attachable to the side plates so as to be movable towards and away from the drum, and the rod is connected to the reciprocating block to correspond to the clamp body.

11. The device of claim 7, wherein the clamp body includes a notched groove disposed to correspond to the end of the rod, and the contact point (X is on a bottom surface of the notched groove.

12. The device of claim 7, further comprising a trailing end clamp unit removably attachable downstream from the clamping unit with respect to a rotating direction of the rotary drum, with the trailing end clamp unit having substantially the same structure as the clamping unit and being detachable from the rotary drum.

13. A device for holding sheet material wound around a drum, the device comprising:

a rod including an end linearly movable towards and away from the drum; and a clamp body having a pivot point and being mountable to the drum and operable for clamping the sheet material to a peripheral surface of the drum in accordance with movement of the end of the rod, wherein a line which passes through said pivot point and is parallel to a tangential line at an intersection between the peripheral surface of the drum and a line connecting the pivot point and the drum center, is made to intersect at a substantially right angle a locus of movement of the rod such that substantially all physical force is transmitted from the rod to the clamp body and does not cause the drum to rotate.

14. The device of claim 13, further comprising:

a coil spring, disposed between the peripheral surface of the drum and the clamp body, for urging one end of the clamp body towards the peripheral surface of the drum; and a clamping mechanism by which the clamp body is moved to a released position counter to an urging force of the coil spring when the end of the rod contacts the clamp body in accordance with the movement of the rod; and a column disposable on the peripheral surface of the drum pivotably supporting the clamp body.

15. The device of claim 14, further comprising a rotatable shaft attached to the column, with the rotatable shaft rotatably supporting the clamp body.

16. The device of claim 14, wherein a pair of side plates axially supports the rotary drum, and the clamping unit is disposable spanning the distance between the side plates, the clamping unit including a reciprocating block attachable to the side plates so as to be movable towards and away from the drum, and the rod is connected to the reciprocating block to correspond to the clamp body.

17. The device of claim 14, further comprising a trailing end clamp unit removably attachable downstream from the clamping unit with respect to a rotating direction of the rotary drum, with the trailing end clamp unit having substantially the same structure as the clamping unit and being detachable from the rotary drum.

18. The device of claim 17, wherein there are a plurality of the clamp bodies, the rods and the clamping mechanisms, and the plurality of the clamp bodies, the rods and the clamping mechanisms are disposed along a longitudinal direction of the drum.

19. The device of claim 13, wherein the clamp body includes a notched groove disposed to correspond to the end of the rod, and a force is applied to the clamp body by the end of the rod contacting the notched groove when the rod is moved towards the drum.

20. The device of claim 19, wherein the notched groove includes a depth such that a straight line connecting the pivot point of the clamp body and a point of contact between the rod and the notched groove intersects at a substantially right angle a locus of movement of the contact point.

* * * * *